US006228459B1

(12) United States Patent
Bujalski

(10) Patent No.: US 6,228,459 B1
(45) Date of Patent: May 8, 2001

(54) ABSORBENT WINE BOTTLE WRAP

(76) Inventor: Dolores A. Bujalski, 7989 Dogwood Path, Victor, NY (US) 14564

( * ) Notice: Subject to any disclaimer, the term of this patent is extended or adjusted under 35 U.S.C. 154(b) by 0 days.

(21) Appl. No.: 09/471,841

(22) Filed: Dec. 23, 1999

(51) Int. Cl.[7] ..... B32B 3/06; B32B 3/10
(52) U.S. Cl. ..... 428/80; 428/136; 215/392
(58) Field of Search ..... 215/392; 222/108; 428/80, 136

(56) References Cited

U.S. PATENT DOCUMENTS

| | | | | |
|---|---|---|---|---|
| D. 368,000 | | 3/1996 | Mazza et al. | D7/625 |
| D. 403,209 | | 12/1998 | Zigterman | D7/625 |
| 2,200,616 | | 5/1940 | Cloud | 40/4 |
| 2,219,562 | | 10/1940 | Painter | 40/4 |
| 3,063,590 | * | 11/1962 | Hopkins | 428/136 |
| 4,867,214 | | 9/1989 | Fuller | 428/35.8 |
| 5,188,877 | | 2/1993 | Magaro | 428/80 |

* cited by examiner

*Primary Examiner*—Alexander S. Thomas

(74) *Attorney, Agent, or Firm*—Brown & Michaels, P.C.

(57) ABSTRACT

An absorbent wrap for placement on a neck of a bottle containing a beverage includes a flexible, absorbent sheet having a slit therethrough and having at least three sides defining two opposing corner portions. A first of the opposing corner portions is located proximate to the slit and includes a first edge. A second of the opposing corner portions is located distal from the slit, includes a second edge, and is tapered toward the second edge. The slit has a length sufficient to allow the second corner portion to be inserted therethrough and tied to the first corner portion. This configuration permits the absorbent wrap to be wrapped around the neck of the bottle and then to be secured to the bottle by inserting the second corner portion through the slit and pulling it snug. The wrap is thereby positioned to absorb drips and spillage of the beverage running down the neck of the bottle. An appropriately sized wrap functions without substantially covering a label portion of the bottle. The wrap is both easily positioned on and removed from the bottle, which facilitates serving a beverage and subsequently disposing of the spent bottle separately from the wrap. The presentation of a beverage such as a wine by a server is quicker and less intrusive, service aspects typically valued by a customer. The wrap is conveniently and inexpensively fabricated either from a relatively durable, washable material or from a limited or single-use material.

19 Claims, 4 Drawing Sheets

ABSORBENT WINE BOTTLE WRAP

FIELD OF THE INVENTION

The invention relates to an absorbent wrap for placing around the neck of a bottle. More particularly, the invention pertains to an absorbent wrap for placing around a wine bottle.

BACKGROUND OF THE INVENTION

It is common in restaurants, wineries, and other settings to serve beverages from bottles by pouring a first portion from the bottle into a glass and then serving up subsequent portions from the same bottle. In the process, spillage and drips that accumulate around the bottle opening and run down the neck of the bottle can stain clothes, tableclothes, furniture, and carpeting, especially if the beverage is a substance such as a red wine. Another problem is that the surface of the bottle can become slippery and difficult to hold.

Servers therefore employ various means and techniques to surmount the problem. One approach is to wrap an absorbent towel around substantially the entire bottle, leaving just a portion of the neck and the opening exposed, to absorb any spillage. A problem with this approach is that the towel easily slips off the bottle or the bottle itself slips from one's grasp while serving. Another problem is that the towel often obscures the label portion of the bottle, proving a hindrance to patrons such as wine afficionados who enjoy reading the label or to vintners who wish to prominently display the vintage and other relevant label description in restaurants, at wine tastings, or at other special gatherings.

Another approach as described in U.S. Pat. No. 4,867,214 employs an insulating/decorative jacket resembling a formal dinner attire. e.g. a tuxedo, that covers most of the bottle and into which the bottle is inserted. A problem with this approach is that once again the label is obscured. Another problem is that the jacket is not primarily fabricated to be absorbant but rather to insulate. Yet another problem is that the jacket is not adaptable to varying bottle sizes, shapes, or diameters since it is designed to receive just one size and shape of bottle.

Another device as found in U.S. Pat. No. 5,188,877 is an insulating wrap that is wrapped around substantially the entire bottle, again obscuring the label portion. It includes velcro-type fasteners along a bottom surface or perimeter. An additional problem with the device is that it is not designed to attach on the neck of the bottle and absorb spillage along the neck portion since its primary purpose is to maintain the bottle at a desired temperature. Another problem is that the device's apex is configured for just one bottle height and the device is therefore not readily adaptable for other bottle sizes or shapes.

SUMMARY OF THE INVENTION

Briefly stated, an absorbent wrap for placement on a neck of a bottle containing a beverage includes a flexible, absorbent sheet having a slit therethrough and having at least three sides defining two opposing corner portions. A first of the opposing corner portions is located proximate to the slit and includes a first edge. A second of the opposing comer portions is located distal from the slit, includes a second edge, and is tapered toward the second edge. The slit has a length sufficient to allow the second corner portion to be inserted therethrough. This configuration permits the absorbent wrap to be wrapped around the neck of the bottle and then to be secured to the bottle by inserting the second corner portion through the slit and pulling it snug. The wrap is thereby positioned to absorb drips and spillage of the beverage running down the neck of the bottle.

The wrap, or "Wine-Kerchief" as it is currently referred to for marketing purposes, prevents or minimizes drips running along the neck of a bottle, making it less likely that a beverage will spill on a diner or the bottle slip from the server's hand while serving. Once secured, both the interlocked corner portions and the main sheet portion of the wrap absorb spillage around substantially the entire circumference of the bottle neck, while the main sheet portion also absorbs spillage along a portion of the bottle's outer surface. An appropriately sized wrap carries out these functions without substantially obscuring a back or front label portion of the bottle. The wrap is both easily positioned on and removed from the bottle, which facilitates serving a beverage and subsequently disposing of the spent bottle separately from the wrap. In a restaurant or other food or beverage establishment setting, the presentation of a beverage such as a wine to a diner by a server is quicker and less intrusive, service features that are typically valued and appreciated by knowledgeable restaurant patrons, food and wine critics, wine afficionados, and other consumers. The wrap is fabricated either from a relatively durable, washable material or from a limited or single-use material, which in either case provides a convenient and inexpensive approach for a restaurant, a business, or an individual consumer. Another advantage is that one size of wrap is adaptable for use with a range of different sizes and shapes of bottles.

According to the invention, a method for absorbing drips from a bottle containing a beverage, the bottle including an upper neck portion and a lower body portion, includes the steps of providing an absorbent wrap comprising a flexible, absorbent sheet having at least three sides defining two opposing corner portions and having a slit therethrough, and wherein a first of the opposing corner portions is located proximate to the slit, a second of the opposing corner portions is located distal from the slit, and the slit has a length sufficient to allow the second corner portion to be inserted therethrough and tied to the first corner portion, positioning the wrap around the neck portion of the bottle, inserting the second corner portion into the slit, and drawing the second corner portion through the slit, whereby the wrap is secured on the neck of the bottle above the body portion to absorb drips running down the neck of the bottle.

According to the invention, an absorbent wrap for placement on a neck of a wine bottle includes a triangular-shape flexible, absorbent sheet having a first side, a second side, and a third side, wherein the first side has a length of between about 10 inches and about 14 inches, the second and third sides are of a substantially equal length and each of the second and third sides has a length between about 7 inches and about 9 inches, and the first side has a first end and a second end respectively located at a first corner and a second corner of the sheet, and a through-slit in the sheet having a transverse orientation with respect to the first side, wherein the slit has a length of between about ¾ inch and 1 ¼ inches, the slit includes an edge closest to the first side that is spaced between about 0.25 inch and about 1 inch from the first side, the slit includes a centerpoint located at least between about 1 inch and about 3 inches from the first end of the first side and at least between about 8 inches and about 10 inches from the second end of the first side, whereby the second corner may be inserted through the slit, thereby securing the wrap on the wine bottle with the wrap positioned to absorb drips running down the neck of the wine bottle.

DESCRIPTION OF THE PREFERRED EMBODIMENTS

Figure 1:
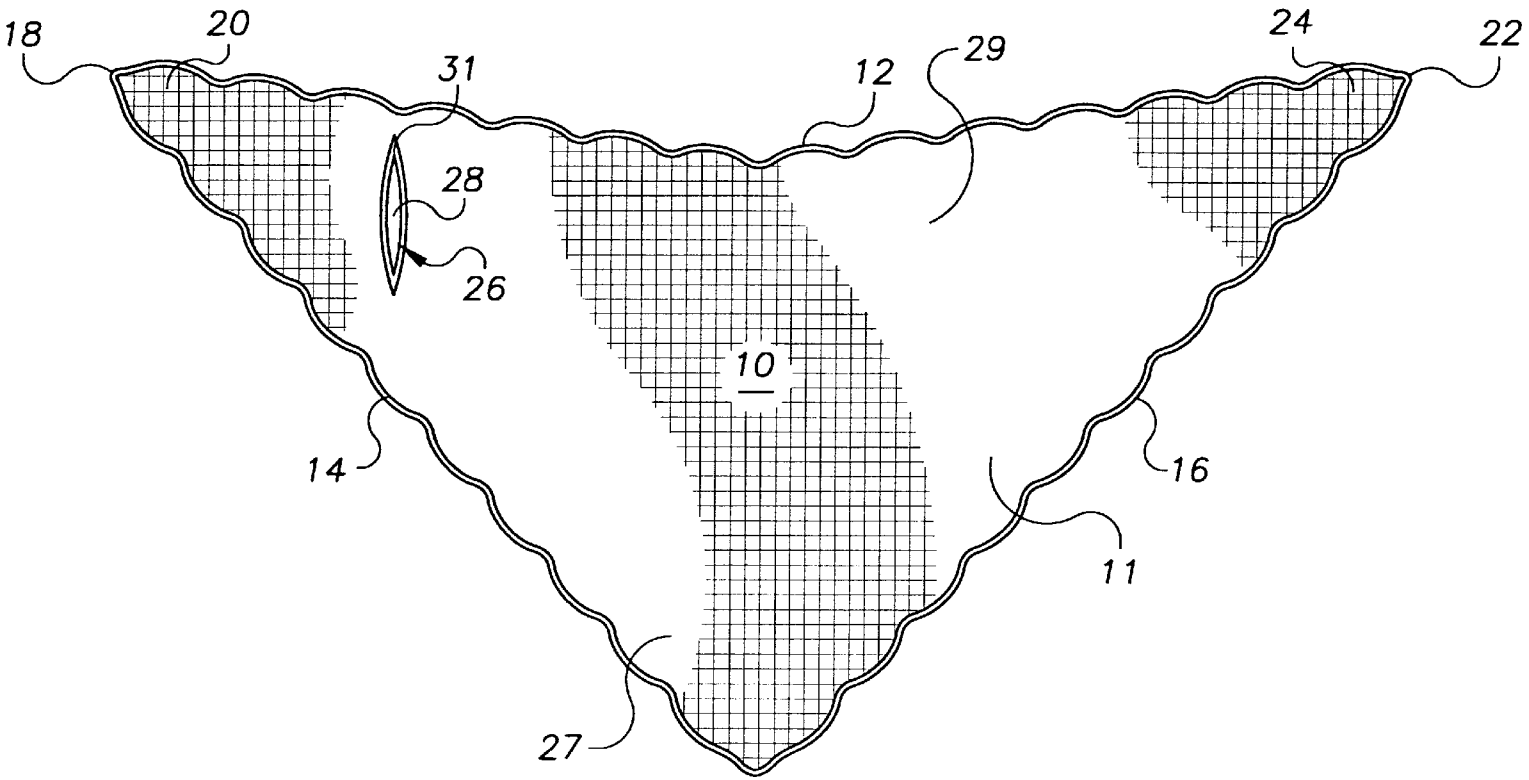
FIG. 1 shows an elevational view of an absorbent bottle wrap according to the invention.
Figure 2:
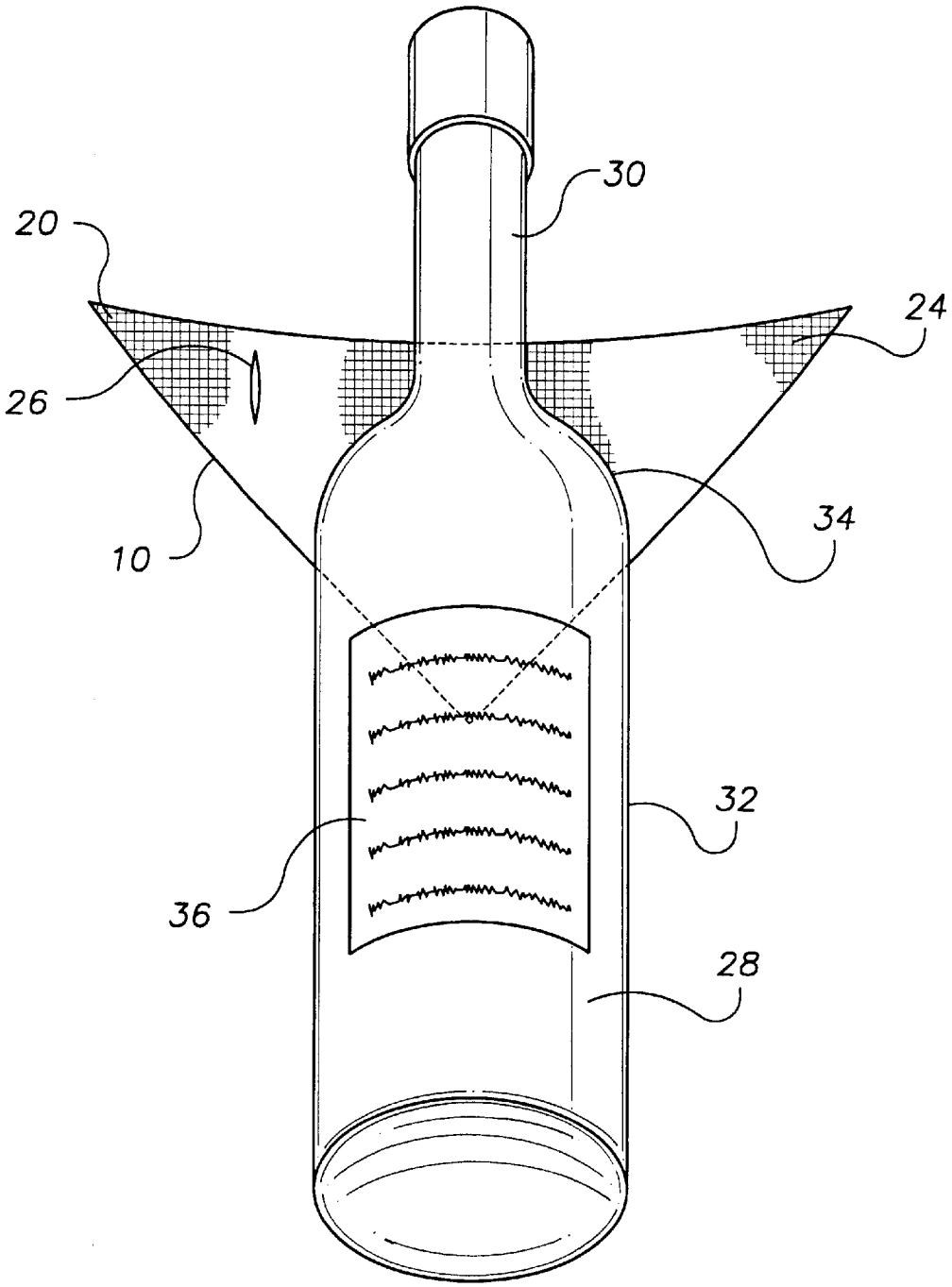
FIG. 2 shows a perspective view, partially in phantom, of an absorbent wrap placed against a bottle according to the invention.

Referring to FIGS. 1 and 2, an absorbent wrap 10 includes a sheet 11 having at least three sides 12, 14 and 16. Sheet 11 is preferably triangular in shape as shown and resembles a kerchief Side 12 extends from an end 18 at a corner 20 to an end 22 at an opposing corner 24. Other shapes (not shown) include wrap 10 having four or more sides or having a semi-circular configuration with one side 12 and a curved perimeter portion extending from end 18 to end 22.

Sheet 11 includes a bottom portion 27 and a top portion 29 that includes a through-slit 26 located proximate to corner 20 and distal from corner 24, that is, slit 26 is closer to corner 20 than to corner 24, although it should be understood that these relative positions are mutually reversible with slit 26 positioned closer to corner 24. Slit 26 preferably has a transverse orientation with respect to side 12 for reasons that will become apparent below.

Wrap 10 can have varying dimensions, shape or size depending on the particular application and the suitable configuration of wrap 10 for the application. Design considerations include the volumetric capacity, diameter, and height of a bottle 28 and whether it is desired to provide a single wrap 10 is fit a variety of different bottles 28 with varying volumetric capacities or shapes. It is particularly desirable to provide a wrap 10 that can fit onto a neck 30 of a wine bottle 28, especially a wine bottle having a volumetric capacity of about 750 ml or 1.51 and a conventional shape as shown in FIGS. 2 and 3.

A standard 750 ml wine bottle has a lower body portion 32 having an outside diameter (OD) of between about 2.8 inches and about 3.2 inches and a height of between about 6 inches and 8 inches, a neck 30 having an OD of between about 0.7 inches and about 1.2 inches and a height of between about 2.5 inches and 3.5 inches, a tapered section 34 joining neck 30 and lower body 32 having a length of between about 1 inch and 2 inches, and an overall bottle height of between about 11 inches and 12 inches. A standard 1.5 liter wine bottle lower body 32 has an OD of between about 3.8 inches and 4.2 inches and a height of between about 6½ inches and 8½ inches, neck 30 has an OD of between about 0.7 inches and about 1.2 inches and a height of between about 3 inches and 4 inches, tapered section 34 has a length of between about 1½ inches and 2½ inches, and the overall bottle height is between about 12 inches and 13 inches. A suitably sized wrap 10 for use with a bottle 30 conforming to either of these two sets of dimensions preferably has a side 12 that is between about 14½ and 18½ inches in length, sides 14 and 16 each preferably about the same length of between about 10 and 13 inches, and slit 26 preferably between about 1 inch and 2 inches in length with an end 31 closest to side 12 that is preferably spaced between about 0.25 inch and about 1 inch from side 12. A centerpoint location 28 on slit 26 is preferably located at least between about 2 inches and about 5 inches from end 18 and at least between about 11 inches and about 15 inches from end 22. Particularly preferred is a wrap 10 having a length of about 16½ inches for side 12, lengthes of about 11½ inches for sides 14 and 16, a length of about 1½ inches for slit 26, end 27 of slit 26 spaced from side 12 by about ½ inch, and centerpoint 28 about 3½ inches from end 18 and about 13½ inches from end 22.

Figure 4:
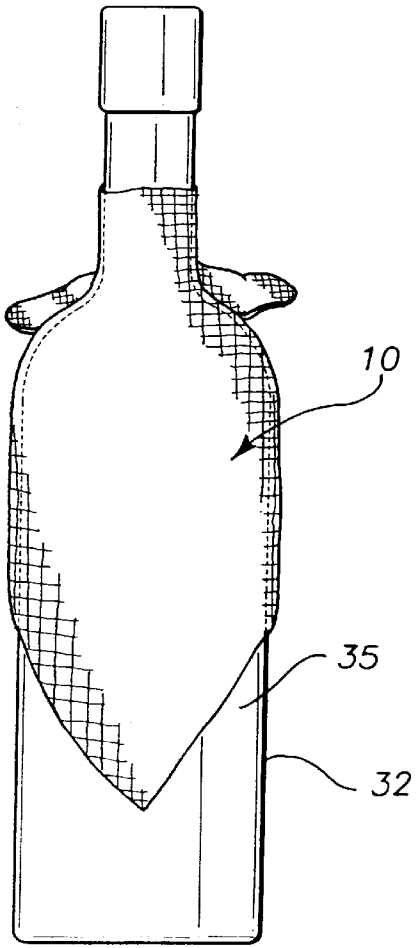
FIG. 4 shows a rear, elevational view of an absorbent wrap secured on the neck of the bottle of FIGS. 2 and 3 according to the invention.
Figure 3:
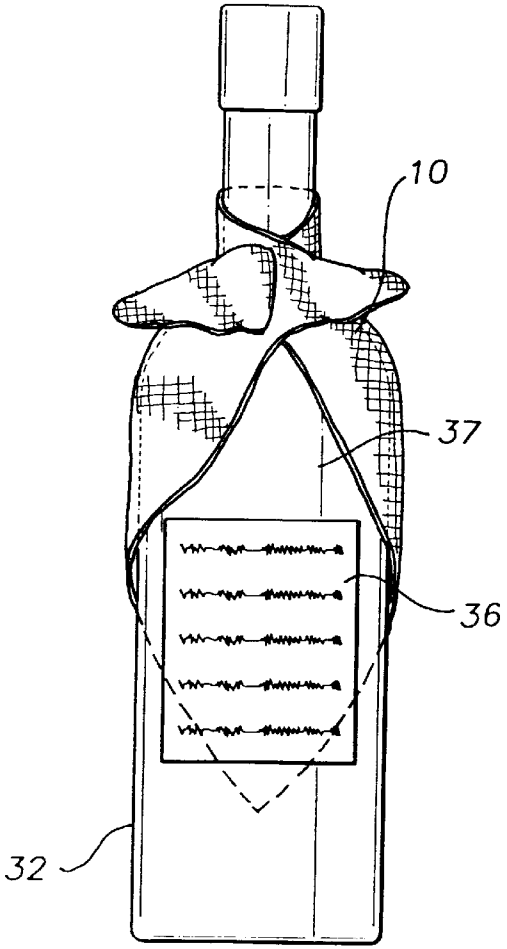
FIG. 3 shows a front, elevational view, partially in phantom, of an absorbent wrap secured on the neck of the bottle of FIG. 2 according to the invention.
Figure 5:
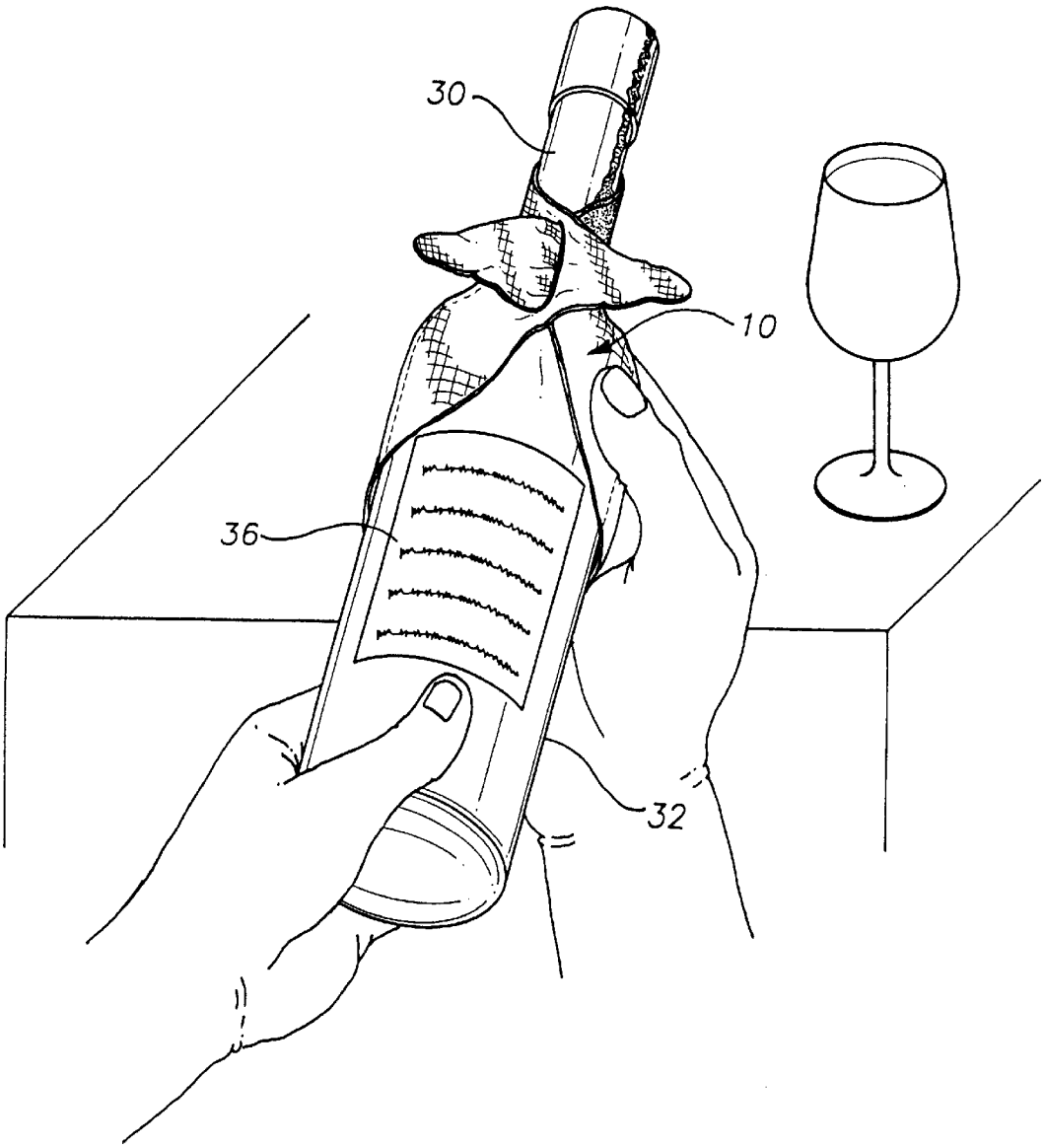
FIG. 5 shows a perspective view of a server pouring from a wine bottle wrapped with an absorbent wrap according to the invention.

Referring to FIGS. 2–4, in use, wrap 10 is positioned against neck 30 of bottle 28. Opposing corners 20 and 24 are then folded around neck 12 from opposite directions and corner 24 is inserted into slit 26 with corner 24 positioned either over corner 20 or under corner 20 depending on whether it is desired to have one or more of corners 20 and 24 lie flat or alternatively protrude as shown in FIGS. 4 and 5. Corner 24 is then drawn through slit 26 an amount sufficient to pull it snug and adequately secure wrap 10 on neck 30. Preferably, bottom portion 27 of wrap 10 is positioned on a rear surface 35 of bottle 32 in order not to obscure front label 36 nor obscure a substantial part of a front surface 37 of bottle 32.

Referring to FIG. 5, after a server has poured from bottle 28, drips running down neck 30 are absorbed by wrap 10, preventing drips from reaching lower body portion 32. Wrap 10 may be fabricated from a durable, reusable material, for example a synthetic such as a polyester, a linen, a natural textile such as a cotton, or a blend of such materials, and in a suitable thickness to provide the desired absorbency. A reusable wrap 10 may be laundered. A preferred thickness for a reusable wrap 10 is between about 1 mil and about 2 mils. Alternatively, wrap 10 may be fabricated from a limited-use or disposable material, such as a cellulosic or pulp-based product, having a suitable absorbency and thickness. A preferred thickness for a disposable wrap 10 is between about 1 mil and about 2 mils. If desired, wrap 10 may be embroidered, embossed, or imprinted with a restaurant's or vintner's monogram, logo, or other design or artwork.

Accordingly, it is to be understood that the embodiments of the invention herein described are merely illustrative of the application of the principles of the invention. References herein to details of the illustrated embodiments are not intended to limit the scope of the claims, which themselves recite those features regarded as essential to the invention.

What is claimed is:

1. An absorbent wrap for placement on a neck of a bottle containing a beverage, comprising a flexible, absorbent sheet having a triangular shape defining two opposing corner portions and having a crosswise slit therethrough, and wherein:

(a) a first of said opposing corner portions is located proximate to said slit;

(b) a second of said opposing corner portions is located distal from said slit; and (c) said slit has a length sufficient to allow after placing said wrap on said bottle said second corner portion to be inserted therethrough and pulled snug, thereby securing said wrap on said bottle such that said wrap is positioned to absorb drips of said beverage running down the neck of said bottle.

2. A wrap as in claim 1, wherein said second corner portion is tapered.

3. A wrap as in claim 2, wherein each of said first and second corner portions is tapered.

4. A wrap as in claim 3, wherein a first side of said wrap located between said first and second corner portions is between about 14½ inches and 18½ inches in length, said slit has a transverse orientation with respect to said first side, said slit is between about 1 inch and 2 inches in length, and said slit has an edge closest to said first side that is spaced between about 0.25 inch and about 1 inch from said first side.

5. A wrap as in claim 4, wherein said sheet is triangular-shaped and has a second side and a third side, said second and third sides are of a substantially equal length, and said length of each of said second and third sides is between about 10 inches and about 13 inches.

6. A wrap as in claim 4, wherein said sheet includes an ornamental design thereon.

7. A wrap as in claim 1, wherein said sheet is linen and has a thickness of between about 1 mil and about 2 mils.

8. A method for absorbing drips from a bottle containing a beverage, said bottle including an upper neck portion and a lower body portion, comprising the steps of:

(a) providing an absorbent wrap comprising a flexible, absorbent sheet having a triangular shape defining two opposing corner portions and having a crosswise slit therethrough, and wherein:

(i) a first of said opposing corner portions is located proximate to said slit;

(ii) a second of said opposing corner portions is located distal from said slit; and (iii) said slit has a length sufficient to allow said second corner portion to be inserted therethrough;

(b) positioning said wrap around the neck portion of said bottle;

(c) inserting said second corner portion into said slit; and (d) drawing said second corner portion through said slit, such that said wrap is secured on the neck of said bottle above the body portion to absorb drips running down the neck of said bottle.

9. A method as in claim 8, wherein said first corner portion is tapered.

10. A wrap as in claim 8, wherein said sheet is a cotton-polyester blend.

11. A method for absorbing drips from a bottle containing a beverage, said bottle including an upper neck portion and a lower body portion, comprising the steps of:

(a) providing an absorbent wrap comprising a flexible, absorbent sheet having at least three sides defining two opposing corner portions and having a slit therethrough, and wherein:

(i) a first of said opposing corner portions is located proximate to said slit; and (ii) a second of said opposing corner portions is located distal from said slit; and (iii) said slit has a length sufficient to allow said second corner portion to be inserted therethrough;

(b) positioning said wrap around the neck portion of said bottle;

(c) inserting said second corner portion into said slit; and (d) drawing said second corner portion through said slit, such that said wrap is secured on the neck of said bottle above the body portion to absorb drips running down the neck of said bottle;

wherein each of said first and second corner portions is tapered, and wherein said method further includes after step (d) a step (e) comprising tying together said first and second corner portions to secure said wrap on said bottle.

12. A method as in claim 11, wherein a first side of said wrap located between said first and second corner portions is between about 14½ inches and 18½ inches in length, said slit has a transverse orientation with respect to said first side, said slit is between about 1 inch and about 2 inches in length, and said slit has an edge closest to said first side that is spaced between about 0.25 inch and about 1 inch from said first side.

13. A method as in claim 12, wherein said sheet is triangular-shaped and has a second side and a third side, said second and third sides are of a substantially equal length, and said length of each of said second and third sides is between about 10 inches and about 13 inches.

14. A method as in claim 12, wherein said sheet includes an ornamental design thereon.

15. A method as in claim 11, wherein said sheet has three sides.

16. A method as in claim 11, wherein said sheet is linen and has a thickness between about 1 mil and about 2 mils.

17. A method as in claim 11, wherein said bottle is a wine bottle.

18. An absorbent wrap for placement on a neck of a wine bottle, comprising:

(a) a triangular-shape flexible, absorbent sheet having a first side, a second side, and a third side, wherein said first side has a length of between about 14½ inches and about 18½ inches, said second and third sides are of a substantially equal length and each of said second and third sides has a length between about 10 inches and about 13 inches, and said first side has a first end and a second end respectively located at a first corner and a second corner of said sheet; and (b) a through-slit in said sheet having a transverse orientation with respect to said first side, wherein said slit has a length of between about 1 inch and 2 inches, said slit includes an edge closest to said first side that is spaced between about 0.25 inch and about 1 inch from said first side, said slit includes a centerpoint located at least between about 2 inches and about 5 inches from said first end of said first side and at least between about 11 inches and about 15 inches from said second end of said first side;

whereby said second corner may be inserted through said slit, thereby securing said wrap on said wine bottle with said wrap positioned to absorb drips running down the neck of said wine bottle.

19. A wrap as in claim 18, wherein said sheet includes an ornamental design thereon.

* * * * *